US007959013B2

(12) United States Patent
Chifflet et al.

(10) Patent No.: US 7,959,013 B2
(45) Date of Patent: Jun. 14, 2011

(54) TELESCOPIC SUPPORT DEVICE FOR MAILPIECE STORAGE BINS

(75) Inventors: Raymond Chifflet, Guilherand Granges (FR); Olivier De Sousa, Saint Uze (FR); Fabrice Eyraud, Portes les Valence (FR); Pierre Jourdan, Valence (FR)

(73) Assignee: Solystic, Gentilly Cedex (FR)

( * ) Notice: Subject to any disclaimer, the term of this patent is extended or adjusted under 35 U.S.C. 154(b) by 324 days.

(21) Appl. No.: 12/279,239

(22) PCT Filed: May 22, 2008

(86) PCT No.: PCT/FR2008/050884

§ 371 (c)(1),
(2), (4) Date: Aug. 13, 2008

(87) PCT Pub. No.: WO2008/149032

PCT Pub. Date: Dec. 11, 2008

(65) Prior Publication Data

US 2010/0219142 A1 Sep. 2, 2010

(30) Foreign Application Priority Data

May 25, 2007 (FR) ..... 07 55256

(51) Int. Cl.
*B42F 17/00* (2006.01)

(52) U.S. Cl. ..... 211/10; 211/80; 211/126.15; 209/630; 414/276

(58) Field of Classification Search ..... 211/11, 211/12, 46, 47, 50, 79, 80, 81, 85.16, 85.17, 211/85.24, 94.01, 94.02, 126.5, 126.15, 133.3, 211/150, 151, 162, 168, 1.57, 17, 116; 209/900, 706, 583, 584, 630; 248/324, 326; 312/322, 323; 414/267, 276

See application file for complete search history.

(56) References Cited

U.S. PATENT DOCUMENTS

| | | | | | |
|---|---|---|---|---|---|
| 321,078 | A | * | 6/1885 | Birckhead | 312/298 |
| 721,992 | A | * | 3/1903 | Anderson | 211/80 |
| 866,043 | A | * | 9/1907 | Madison | 211/80 |
| 1,112,562 | A | * | 10/1914 | Rogman | 211/80 |
| 1,125,182 | A | * | 1/1915 | Rupp | 211/80 |
| 1,137,074 | A | * | 4/1915 | Morris | 312/323 |
| 1,197,576 | A | * | 9/1916 | Doane et al. | 211/80 |
| 1,246,883 | A | * | 11/1917 | Coate | 211/80 |
| 1,292,329 | A | * | 1/1919 | Johnson | 211/80 |
| 1,340,319 | A | * | 5/1920 | Braid | 312/323 |
| 5,115,920 | A | * | 5/1992 | Tipton et al. | 211/59.2 |
| 5,284,336 | A | * | 2/1994 | Ricciardi | 271/213 |
| 5,360,316 | A | * | 11/1994 | O'Mara et al. | 414/798.9 |
| 5,415,300 | A | * | 5/1995 | Krummell et al. | 211/151 |
| 5,482,422 | A | * | 1/1996 | Hammond | 414/276 |
| 5,484,197 | A | * | 1/1996 | Hansen et al. | 312/334.12 |

(Continued)

FOREIGN PATENT DOCUMENTS

DE 199 01 444 C1 2/2000

(Continued)

*Primary Examiner* — Darnell M Jayne
*Assistant Examiner* — Stanton L Krycinski
(74) *Attorney, Agent, or Firm* — Rothwell, Figg, Ernst & Manbeck, P.C.

(57) ABSTRACT

A telescopic support device for supporting a storage bin for storing mailpieces comprises a first slideway with a first slide on which the bin rests, and a second slideway with a second slide, the first slideway being hinged pivotally on the second slide.

9 Claims, 3 Drawing Sheets

U.S. PATENT DOCUMENTS

| | | | | |
|---|---|---|---|---|
| 6,435,353 | B2 * | 8/2002 | Ryan et al. | 209/706 |
| 6,851,562 | B2 * | 2/2005 | Gorniak et al. | 211/59.2 |
| 7,014,030 | B2 * | 3/2006 | Hendzel et al. | 198/368 |
| 7,540,385 | B2 * | 6/2009 | Enenkel et al. | 209/630 |
| 2001/0042706 | A1 | 11/2001 | Ryan et al. | |
| 2003/0006174 | A1 * | 1/2003 | Harres et al. | 209/584 |
| 2007/0056885 | A1 | 3/2007 | Enenkel et al. | |

FOREIGN PATENT DOCUMENTS

| | | |
|---|---|---|
| WO | WO 99/16334 A | 4/1999 |

* cited by examiner

TELESCOPIC SUPPORT DEVICE FOR MAILPIECE STORAGE BINS

CROSS-REFERENCE TO RELATED APPLICATIONS

This application is a 35 U.S.C. §371 National Phase Application from PCT/FR2008/050884, filed May 22, 2008, and designating the United States, which claims the benefit of France Patent Application No. 0755256, filed May 25, 2007.

BACKGROUND OF THE INVENTION

1. Field of the Invention

The invention relates to a telescopic support device for supporting storage bins, and in particular for supporting storage bins for storing mailpieces taken from the sorting outlets of a postal sorting machine. Such mailpieces can be letters or other flat objects or "flats" of small or of large format.

2. Discussion of the Background Art

In postal sorting machines, the sorting outlets are provided with storage members that can be referred to as "stackers" in which sorted mailpieces are stored in stacks and on edge. The mailpieces are then taken manually by an operator from a sorting outlet stacker and transferred in their stacking order to a corresponding storage bin.

In general, a postal sorting machine comprises a feed inlet into which the mailpieces are loaded in stacks, an unstacker for putting the mailpieces in series and on edge, an automatic recipient address reader device operating by Optical Character Recognition (OCR), and a conveying and sorting device that directs each mailpiece whose delivery address is recognized automatically to a particular sorting outlet corresponding to that delivery address. In each sorting outlet, the mailpieces are thus grouped together in a first sorting pass. For the second sorting pass, the mailpieces grouped together in each sorting outlet must be fed back into the inlet of the sorting machine (or of another sorting machine) in a certain order for the second pass of the sorting process. For performing such transfer handling, mailpiece storage bins are used as described in Patent Document US-2007/0056885.

The mailpiece sorting machine described in the above document is shown diagrammatically in FIG. 1. On respective ones of two superposed rows, that sorting machine 1 has upper sorting outlet stackers 2 in which mailpieces 4 are stored, and lower sorting outlet stackers 3 in which mailpieces 5 are stored. As can be seen in FIG. 1, the stackers 2 and 3 are offset vertically so as to clear a space for access to the stackers 3 of the lower level in order to facilitate handling the mailpieces 5 in those stackers 3.

As can be seen in FIG. 1, below each lower-level stacker 3 two mailpiece storage bins 7 and 8 are placed that are mounted on a telescopic support device 6 suitable for being deployed horizontally in such a manner as to make the two bins accessible (in the manner of a drawer) for the purposes of filling them with mailpieces and of moving them towards a bin conveyor (not shown). The bin 7 that is further forward in the drawer-like arrangement serves to be filled with the mailpieces 5 from the lower-level stacker 3 while the bin 8 that is further backward in the drawer serves to receive the mailpieces 4 from the upper-level stacker 2.

As shown in FIG. 1, the bin support device 6 is thus deployable in a horizontal plane between a retracted first position (shown in uninterrupted lines) in which it is retracted into the sorting machine and a deployed second position (shown in dashed lines) in which it is deployed out of the sorting machine.

Such a telescopic bin support suffers from the drawback of taking up a large amount of floor space when in its deployed position. In addition, that known arrangement suffers from the drawback of obliging the operator to make a movement through a very large amplitude, which is therefore very tiring, between the stackers 2 on the upper level and the storage bins that are almost at floor level. That arrangement is therefore not satisfactory as an ergonomic workstation for certain people.

SUMMARY OF THE INVENTION

An object of the present invention is to remedy that drawback by proposing a telescopic support device for storage bins that makes it possible to achieve more satisfactory ergonomics for the workstation, thereby facilitating handling by the operators, and reducing the efforts required for handling the bins.

To this end, the invention provides a telescopic support device for supporting a bin, said telescopic support device being characterized in that it comprises a first slideway with a first slide on which the bin rests, and a second slideway with a second slide, the first sideway being hinged pivotally on the second slide. In accordance with the invention, such a device can advantageously be disposed between two superposed stackers such as the stackers 2 and 3 in FIG. 1.

The telescopic support device of the invention can also present the following particularities:

- adjustable movement-limiting means are provided for limiting the angle through which the first slideway and the second slide can move relative to each other;
- said movement-limiting means are constituted by a cable;
- locking means are provided for preventing the second slide from moving in the second slideway when the first slideway is in an inclined position in which it is inclined relative to the second slideway; and
- said locking means are constituted by a rocker lever that is in a retracted and non-locking position when the first slideway is pivoted down against the second slideway and that is in a locking position when the first slideway is in an inclined position in which it is inclined relative to the second slideway.

The invention thus also provides a postal sorting machine that is provided with a plurality of such telescopic support devices associated with respective ones of a plurality of sorting outlets. According to the invention, when the telescopic support devices are in the retracted position, said bins may be set back from the two rows of sorting outlets in a horizontal direction. The telescopic support devices may have a second slideway that is inclined relative to the horizontal. Each telescopic device may be provided with an angled sheet-metal piece fastened to the first slide of said support device, said angled sheet-metal piece forming a horizontal bridge at the interface between a bin and a sorting outlet that lies vertically above the bin when the support device is in a deployed position.

BRIEF DESCRIPTION OF THE DRAWINGS

An embodiment of the telescopic support device of the invention is described in more detail below and is shown in the drawings. The description is given merely by way of example, the example being given by way of indication and being in no way limiting on the invention. In the drawings.

DETAILED DESCRIPTION OF THE PREFERRED EMBODIMENTS

Figure 1:
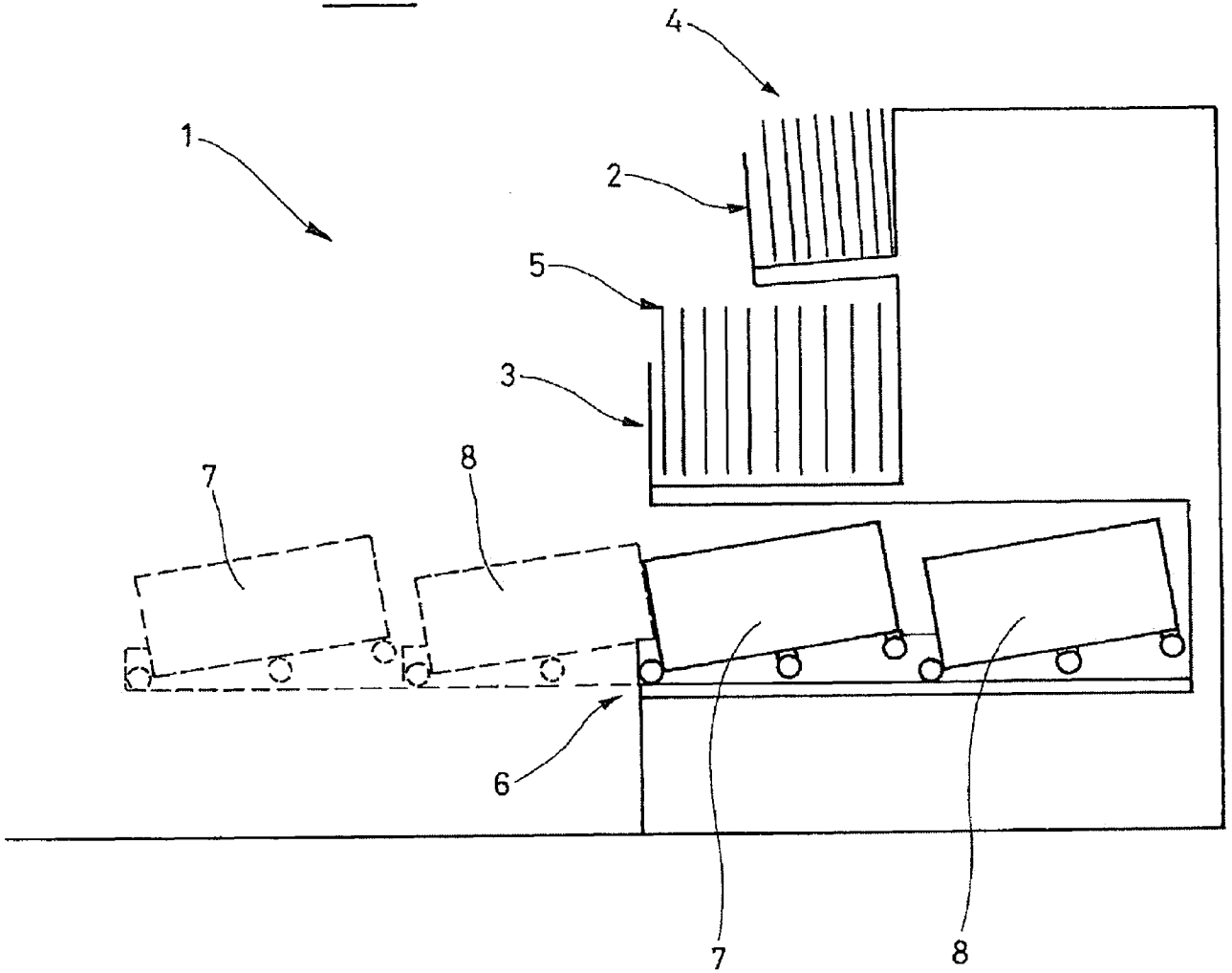
FIG. 1 is a diagrammatic fragmentary section view of a prior art sorting machine.
Figure 2:
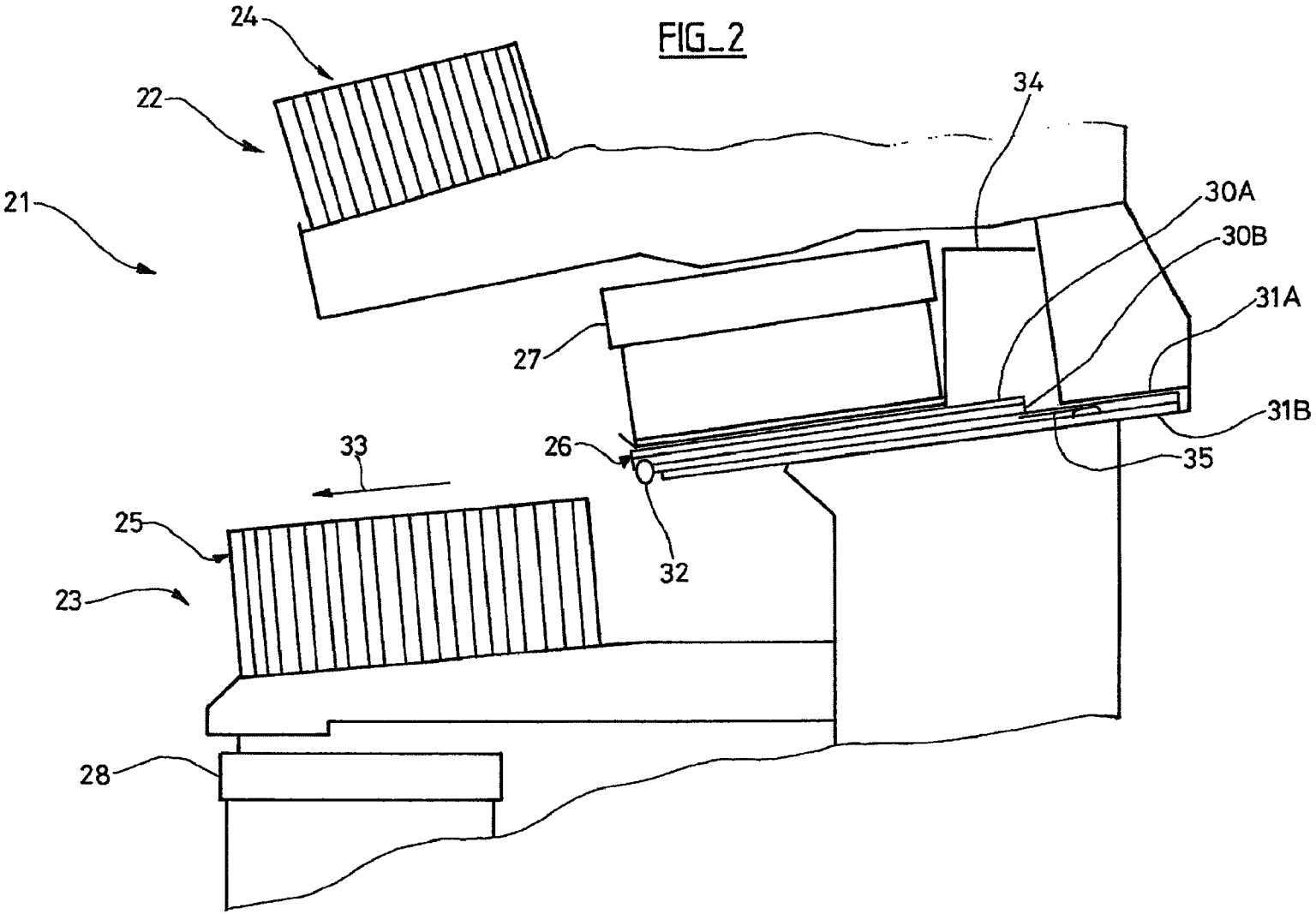
FIG. 2 is a diagrammatic fragmentary section view of a sorting machine equipped with a telescopic support device of the invention in the retracted position.

FIG. 2 shows the sorting outlets of a sorting machine 21 equipped with a telescopic support device of the invention. On respective ones of two superposed rows, the sorting machine 21 has upper sorting outlet stackers 22 disposed above lower sorting output stackers 23, each upper stacker 22 being aligned substantially vertically with a lower stacker 23. For reasons of clarity of the description below, no distinction is made between the sorting outlet stackers and the sorting outlets.

Conventionally, two stacks of mailpieces 24 and 25 are stored on edge in respective ones of the stackers 22 and 23.

Advantageously, a telescopic support device 26 of the invention is disposed vertically between an upper stacker 22 and a lower stacker 23 that are mutually superposed. The telescopic support device 26 disposed in this way is suitable for moving an upper storage bin 27 into the immediate vicinity of and under the upper stacker 22, thereby facilitating the work of the operator while also limiting the risks of mailpieces falling while the stack of mailpieces 24 is being transferred to the upper bin 27.

In the same way, for transferring the stack of mailpieces 25, a lower storage bin 28 is placed immediately under the lower stacker 23.

In particular, the telescopic support device 26 is shown in FIG. 2 in a retracted position in which it is retracted into the sorting machine 21, i.e. set back from the sorting outlet stackers. In accordance with the invention, this retraced position makes it possible to offset the storage bin 27 vertically relative to the stackers 22 and 23, thereby clearing a space for access to the stack of mailpieces 25 in the lower stacker 23. The operator can then pull the storage bin 28 out of the sorting machine 21 while also remaining in the immediate vicinity of the lower stacker 23 so that the mailpieces can be transferred without any risk.

With this arrangement in the retracted position, it is no longer necessary, as it is in the prior art, to offset the two superposed stackers vertically in order to access the stack of mailpieces 25 in the bottom stacker 23. With the invention, the amount of space saved is thus increased.

For example, the telescopic support 26 comprises a first slide 30A mounted to slide in a first slideway 30B disposed above a second slide 31A mounted to slide in a second slideway 31B. The term "slide" is used to mean a mechanical part mounted to slide in a slideway in rectilinear motion. The first slideway 30B is hinged pivotally on the second slide 31A, e.g. by means of a pivot link 32. For example, the pivot link 32 connects the ends of the second slide 31A in the direction indicated by the arrow 33 to the first slideway 30B. A telescopic support 26 constituted in this way is suitable for being deployed longitudinally towards the outside of the sorting machine 21 in the direction indicated by the arrow 33.

The first slide 30A is equipped with an angled sheet-metal piece 34 that extends rearwards from the top edge of the storage bin. As shown in detail in FIG. 3, the angled sheet-metal piece forms a horizontal bridge at the interface between the bin 27 and the upper stacker 22.

Figure 3:
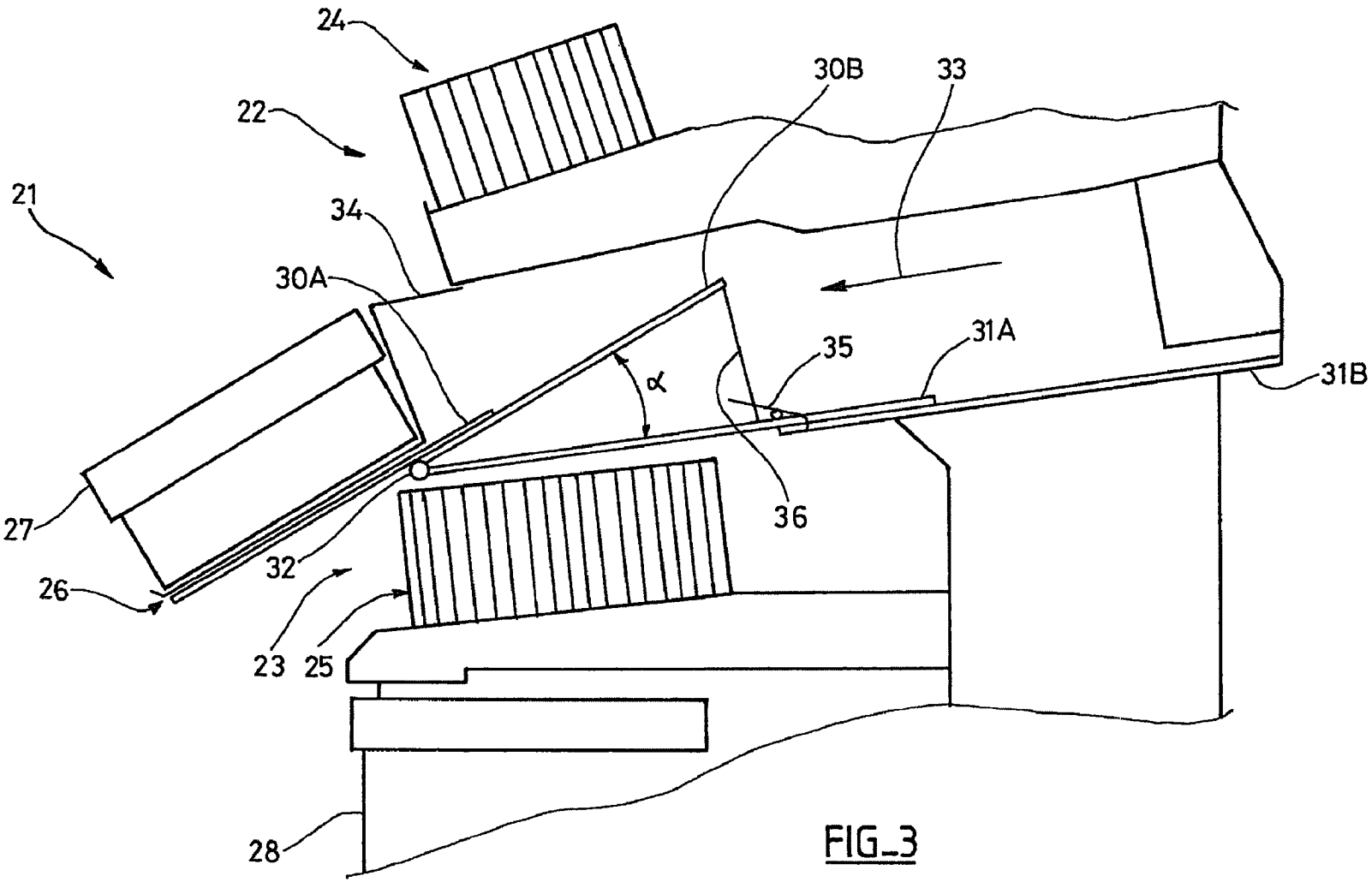
FIG. 3 is a diagrammatic fragmentary section view of a sorting machine equipped with a telescopic support device of the invention in the deployed position.

By pulling on a handle (not shown) on the storage bin 27, the operator causes the telescopic support 26 to be deployed and thus the bin to be moved in the direction indicated by arrow 33. The telescopic support 26 goes from a retracted position in which it is retracted into the sorting machine 21, as shown in FIG. 2, to a deployed position in which it is deployed out of the machine 21, as shown in FIG. 3. This transition takes place in two stages.

The first stage consists in the slides 30A and 31A moving in translation respectively relative to the slideways 30B and 31B. This results in deployment in telescopic manner in the direction indicated by the arrow 33. At the end of this first stage, the bin 27 finds itself in a position in which it is outside of the sorting machine 21, i.e. the bin 27 finds itself in a position symmetrically opposite from the retracted position about an axis formed by the stackers 22 and 23.

The first stage is followed by a second stage in which the bin 27 tilts naturally. In the second stage, the weight of the bin 27 causes the first slide 30A and the first slideway 30B to pivot together relative to the second slideway 31B and to the slide 31A, the second slideway 31B being fastened to the frame of the sorting machine 21. It can be understood that the first slide 30A and the second slide 30B are constrained to pivot together, i.e. they undergo the same tilting during the second stage.

At the end of the second stage, the telescopic support 26 finds itself in the position shown in FIG. 3. The deployment lengths over which the slideways and the slides are deployed, and their inclinations are computed so that the storage bin 27 in the out position finds itself positioned in the immediate vicinity of the upper stacker 22, without being in contact with the lower stack of mailpieces 25.

In FIG. 3, the telescopic support device 26 is shown in deployment in its position in which it is deployed out of the machine 21.

The pivot angle through which the slideway 30B can move relative to the slide 31A is limited, for example, by means of a cable 36 having one of its ends fastened to the slideway 30B and its other end fastened to the slide 31A. The angle of inclination a of the slideway 30B relative to the slide 31A can thus be adjusted by setting the length of cable used. Depending on the inclination, the storage bin moves downwards to a greater or lesser extent, thereby adapting to accommodate various operator morphologies. For example, the pivot angle can be adjusted to match the height of the operator. Handling by the operator is facilitated and the efficiency of said operator is improved.

Advantageously, when the telescopic support 26 is in the deployed position, the space occupied corresponds to the length of one bin only. The invention thus enables a significant saving in space to be achieved.

In addition, in accordance with the invention, the angled sheet-metal piece 34 that is fastened to the first slide 30A constitutes a bridge between the upper stacker 22 and the upper edge of the storage bin 24. By means of this arrangement, mailpieces that are being moved by hand in packets from the stacker to the bin are prevented from falling, thereby maintaining the mailpiece sequence resulting from the first sorting pass. Alternatively, the packets of mailpieces can be brought into the bin 27 by being slid over the bridge 34.

In addition, the telescopic support 26 is further provided with locking means 35 for locking it in translation, which means are fastened pivotally to the second slide 31A. Said locking means are, for example, in the form of a rod operating as a rocker lever having one of its ends in contact with the first slideway 30B and its other end provide with a hook designed to be inserted into an opening formed in the second slideway 31B.

Before the second tilting stage, the first slideway 30B bears on the end of the locking means 35. When the locking means 35 are in this position that is shown in FIG. 2, the hook is disengaged from the opening and the second slide 31A can move in translation relative to the second slideway 31B.

Conversely, after the tilting stage that is shown in FIG. 3, the first slideway 30A releases the end of the locking means 35, thereby causing the lever to tilt under gravity. The hook engages in the opening in the second slideway 31B. When the locking means 35 are in this position, the second slide 31A is prevented from moving in translation relative to the second slideway 31B.

Therefore, in the position shown in FIG. 3, the telescopic support cannot be moved back into the sorting machine 21 towards the retracted position without the operator firstly pivoting the first slide 30A and the first slideway 30B relative to the second slide 31A and to the second slideway 31B. The locking means 35 thus prevent the operator from retracting the telescopic support while the first slide 30B is still in the inclined position, and thus prevent the telescopic support from colliding with the lower stack 25. Naturally, in any event, the telescopic support 26 cannot be retracted into a confined space inside the sorting machine with the slideway 30B inclined because said confined space is designed to occupy, in the height direction, only enough space to allow the bin to pass through. The locking means thus oblige the operator to perform a transition in two stages that are necessarily successive in order to go from the deployed position shown in FIG. 3 to the retracted position shown in FIG. 2.

In the first stage, the operator raises the storage bin 27 which tilts about the pivot link 32 so that the slides 30A and 31A and the slideways 30B and 31B are parallel. With this tilting, the first slideway 30B comes into contact with the locking means 35 which, in turn, tilt. The hook disengages from the opening, thereby releasing the second slide 31A so that said second slide can move in translation relative to the second slideway 31B.

The first stage is followed by a second stage in which the operator pushes the telescopic support into the sorting machine 21 in the direction opposite from the direction indicated by the arrow 33. In particular, the effort made by the operator causes the slides 30A and 31A to move in translation respectively relative to the slideways 30B and 31B. As a result, the support device retracts in telescopic manner.

At the end of the second stage, the telescopic support 26 finds itself in the retracted position shown in FIG. 2. Conventionally, other locking means (not shown) lock the storage bin in the retracted position. Said other locking means are unlocked merely by the operator pulling in the direction indicated by the arrow 33.

In the particular embodiment shown in FIGS. 2 and 3, the telescopic support is inclined slightly, which offers the advantage of jogging the mailpieces against the front wall of the storage bin.

The invention claimed is:

1. A postal sorting machine comprising two superposed sorting outlets and a telescopic support device interposed between the sorting outlets, wherein said telescopic support device includes a first slideway with a first slide and a second slideway with a second slide, the first slide of the first slideway being adapted to support a mailpiece bin, the second slideway being fastened to the machine, the first slideway having a first end facing away from the machine and the second slide having a second end facing away from the machine, the first slideway being hinged pivotally on the second slide by means of a pivot link connecting said first end to said second end.

2. A postal sorting machine according to claim 1, further comprising adjustable movement-limiting means for limiting the angle through which the first slideway and the second slide can move relative to each other.

3. A postal sorting machine according to claim 2, in which said movement-limiting means includes a cable.

4. A postal sorting machine according to claim 1, further comprising locking means for preventing the second slide from moving in the second slideway when the first slideway is in an inclined position in which it is inclined relative to the second slideway.

5. A postal sorting machine according to claim 4, in which said locking means includes a rocker lever that is in a retracted and non-locking position when the first slideway is pivoted down against the second slideway and that is in a locking position when the first slideway is in an inclined position in which it is inclined relative to the second slideway.

6. A postal sorting machine according to claim 1, comprising two superposed rows of sorting outlets, and one row of telescopic support devices interposed between the two rows of sorting outlets, each telescopic support device supporting a mailpiece bin.

7. A postal sorting machine according to claim 1, in which, when the telescopic support device is in a retracted position, said bin is set back from the sorting outlets in a horizontal direction.

8. A postal sorting machine according to claim 1, in which the second slideway of the telescopic support device is inclined relative to the horizontal.

9. A postal sorting machine according to claim 1, in which each telescopic device is provided with an angled sheet-metal piece adapted to form a horizontal bridge at the interface between a bin and a sorting outlet that lies vertically above the bin when the support device is in a deployed position.

* * * * *